US007399195B2

(12) United States Patent
Kim et al.

(10) Patent No.: US 7,399,195 B2
(45) Date of Patent: Jul. 15, 2008

(54) CONNECTOR POSITION ASSURANCE DEVICE AND CONNECTOR ASSEMBLY INCORPORATING THE SAME

(75) Inventors: Byung Yong Kim, Hainesville, IL (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/634,269

(22) Filed: Dec. 6, 2006

(65) Prior Publication Data

US 2008/0139035 A1 Jun. 12, 2008

(51) Int. Cl.
*H01R 13/627* (2006.01)

(52) U.S. Cl. ..... 439/352; 439/353; 439/357

(58) Field of Classification Search ..... 439/352–354, 439/357, 489, 358, 701, 157, 488, 575, 595
See application file for complete search history.

(56) References Cited

U.S. PATENT DOCUMENTS 5,507,666 A * 4/1996 Yamanashi ..... 439/489
5,591,041 A 1/1997 Cecil, Jr. et al.
5,628,649 A * 5/1997 Yagi et al. ..... 439/489
5,910,027 A * 6/1999 Wayt et al. ..... 439/489
5,947,763 A * 9/1999 Alaksin ..... 439/489
6,068,507 A 5/2000 Popa
6,234,826 B1 * 5/2001 Wilber et al. ..... 439/352
6,261,116 B1 * 7/2001 Ceru ..... 439/352
6,361,356 B1 3/2002 Heberlein et al.
6,406,319 B2 * 6/2002 Pederson et al. ..... 439/352
6,435,895 B1 * 8/2002 Fink et al. ..... 439/352
6,780,045 B2 * 8/2004 Shuey et al. ..... 439/489
7,201,599 B2 * 4/2007 Holub ..... 439/357
2003/0171027 A1 9/2003 Shuey et al.

OTHER PUBLICATIONS

International Search Report for Application No. PCT/US07/23762, dated Mar. 25, 2008.

* cited by examiner

*Primary Examiner*—T. C. Patel
*Assistant Examiner*—Harshad C Patel
(74) *Attorney, Agent, or Firm*—Rader, Fishman & Grauer, PLLC

(57) ABSTRACT

A connector position assurance device includes a base panel member and a latch assembly connected to and extending generally perpendicularly from the base panel member. The latch assembly has a tongue part and a pair of rails disposed apart from and extending parallel to one another. The tongue part is positioned between and disposed apart from the pair of rails to define a pair of open-ended stop-receiving channels. The tongue part is formed with a slot and a follower projection is connected to the tongue part forward of the slot. The tongue part is movable, in an upward direction, to and between a relaxed normal position and an upward flexed position and, in a downward direction, to and between the relaxed normal position and a downward flexed position. The tongue part is resiliently biased to the relaxed normal position. A connector assembly incorporates the connector position assurance device.

13 Claims, 11 Drawing Sheets

CONNECTOR POSITION ASSURANCE DEVICE AND CONNECTOR ASSEMBLY INCORPORATING THE SAME

FIELD OF THE INVENTION

The present invention relates to a connector position assurance device and a connector assembly that incorporates the connector position assurance device.

BACKGROUND OF THE INVENTION

Many different types of connector position assurance devices used with electrical connectors are well known in the art. One such connector position assurance device is described in U.S. Pat. No. 6,261,116 to Ceru. This connector position assurance element includes a horizontal base portion, a stem, a finger-graspable crossbar, deflectable side arms and a shoulder. The horizontal base portion has an insertion end and a withdrawal end. The stem extends vertically from the withdrawal end of the base portion. The finger-graspable crossbar is positioned on an end of the stem distal from the base portion. The deflectable side arms extend from the withdrawal end of the base portion at an upward acute angle and terminate in a free end adjacent and above the insertion end. The shoulder is located between the stem and the deflectable side arms with the shoulder defining a horizontal seat above the base portion and below the crossbar.

A drawback regarding the connector assurance device of Ceru is that permanent stress is applied to the side arms when the connector position assurance device is engaged.

Another connector position assurance device known in the art is described in U.S. Pat. No. 6,435,895 to Fink et al. This connector position assurance device is provided with a connector position assurance channel into which a connector position assurance slide is located. The connector position assurance slide interacts with the connector position assurance channel snappingly at two sliding positions of the connector position assurance slide assurance slide interacts with the connector position assurance channel snappingly at two sliding positions of the connector position assurance slide relative to the channel, namely a pre-staged position and a staged position. A connector position assurance actuation lock is provided. The connector position assurance channel includes a pair of channel abutments and the connector position assurance slide has a pair of resilient arms, the ends of which abut, respectively, the channel abutments when the connector position assurance slide is at the pre-staged position. The abutting interaction of the channel abutments with respect to the resilient arms prevents the connector position assurance slide from being snappingly slid to the staged position.

A drawback associated with the connector position assurance device of Fink et al. is that there is no guide channel on the connector housing to assure stable position of the connector position assurance device when it is engaged with the connector housing.

It would be beneficial to provide a connector position assurance device that is not permanently stressed when it is engaged with a connector housing. It would also be beneficial to provide a connector position assurance device that can be stably positioned within the connector housing when connector position assurance device is engaged therewith. The present invention provides these benefits.

SUMMARY OF THE INVENTION

One exemplary embodiment of the present invention is a connector position assurance device that includes a base panel member and a latch assembly. The latch assembly is connected to and extends generally perpendicularly from the base panel member. The latch assembly has a tongue part and a pair of rails disposed apart from and extending parallel to one another. The tongue part is positioned between and is disposed apart from the pair of rails to define a pair of open-ended stop-receiving channels between the tongue part and respective ones of the pair of rails.

Another exemplary embodiment of the present invention is a connector assembly that includes a first connector housing, a second connector housing and a connector position assurance device. The first connector housing has a first connector opened end, a first connector inner cavity and a first connector locking protrusion extending from a first connector upper wall into the first connector inner cavity. The second connector housing is sized and adapted to be received by the first connector inner cavity through the first connector opened end. The second connector housing has a second connector opened end, a second connector inner cavity, a second connector latch assembly with a cross-bar locking element and a second connector latch hole defined in part by the cross-bar locking element, a second connector bottom wall facing the second connector latch assembly, a pair of facially opposing second connector side walls, at least one stop element disposed between the second connector latch assembly and the second connector bottom wall and a second connector upwardly projecting locking protrusion projecting upwardly from the second connector bottom wall. The second connector housing includes a joist structure disposed within the second connector inner cavity. The joist structure has a pair of joists disposed apart from one another and extends in the insertion direction. A respective one of the pair of joists is disposed apart from a respective one of the second connector side walls and the second connector bottom wall to form a rail-receiving channel therebetween. The second connector latch assembly is operative to move to and between a normal, relaxed condition and a downward flexed condition with the second connector latch assembly being resiliently biased to the normal relaxed condition.

The connector position assurance device is sized and adapted to be received by the second connector inner cavity. The connector position assurance device has a base panel member and a latch assembly connected to and extending generally perpendicularly from the base panel member. The latch assembly has a tongue part with a forward portion and a pair of rails disposed apart from and extending parallel to one another. The tongue part is positioned between yet disposed apart from the pair of rails to define a pair of open-ended stop-receiving channels between the tongue part and respective ones of the pair of rails. The tongue part is formed with a slot and a follower projection connected to the tongue part forward of the base panel member and the slot. The tongue part is movable, in an upward direction, to and between a relaxed normal position and an upward flexed position and, in a downward direction, to and between the relaxed normal position and a downward flexed position being opposite the upward flexed position with the tongue part being resiliently biased to the relaxed normal position.

With respective ones of the pair of rails of the connector position assurance device aligned with respective ones the rail-receiving channels of the second connector housing in order to slidably receive the pair of rails in a close-fitting relationship, the connector position assurance device is inserted into the second connector inner cavity in the insertion direction at a first insertion force sufficient to cause the tongue part to slide over the second connector upwardly projecting locking protrusion thereby moving the tongue part from the relaxed normal position to the upward flexed position while the tongue part is in sliding contact with and slides over the second connector upwardly projecting locking protrusion and then the tongue part moves from the upward flexed position to the relaxed normal position when a forward end of the tongue part loses sliding contact with the second connector upwardly projecting locking protrusion. The follower projection confronts the cross-bar locking element and the slot receives the second connector locking protrusion at a forward end portion of the slot to render the connector position assurance device in a pre-set stage partially within the second connector inner cavity.

Thereafter the second connector housing with the connector position assurance device in the pre-set stage is inserted into the first connector inner cavity in the insertion direction by being received in the first connector inner cavity such that the first connector locking protrusion in sliding contact with the cross-bar locking element pushes downwardly on the cross-bar locking element thereby moving the second connector latch assembly from the normal relaxed condition to the downward flexed condition and the second connector latch assembly returns to the normal relaxed condition as the first connector locking protrusion loses sliding contact with the cross-bar locking element and the first connector locking protrusion in sliding contact with the follower projection pushes downwardly on the follower projection thereby moving the tongue part from the relaxed normal position to the downward flexed position so that the forward portion of the tongue part in sliding contact with the at least one stop element slides underneath the at least one stop element and the follower projection in sliding contact slides under the first connector locking protrusion and the cross-bar locking element and the tongue part returns to the normal relaxed position after losing sliding contact with the cross-bar locking element such that the at least one stop element is disposed within one of the opened-ended stop-receiving channels thereby rendering the connector position assurance device in a final locked stage.

The present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
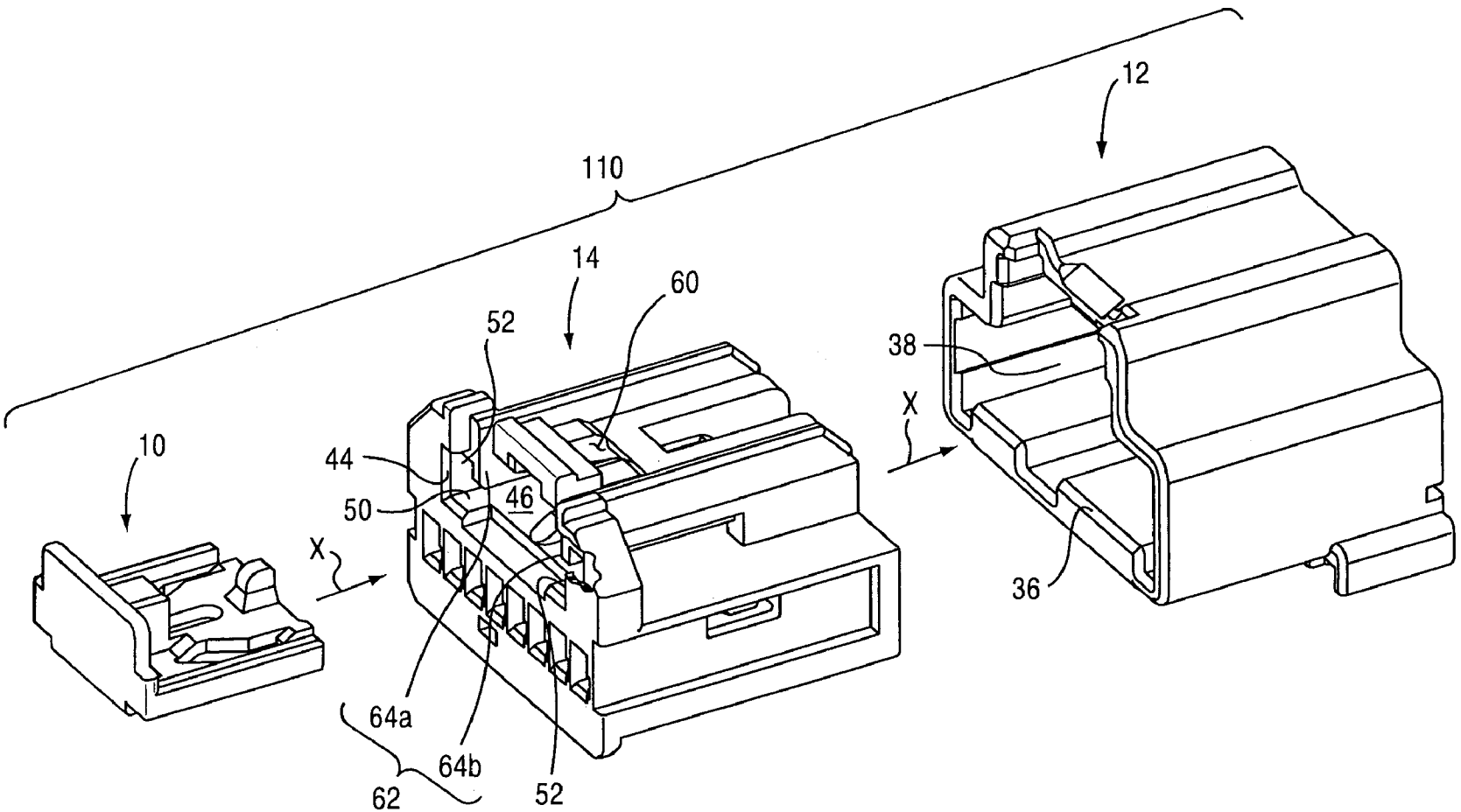
FIG. 1 is an exploded perspective view an exemplary embodiment of a connector position assurance device of the present invention as a component of a connector assembly also including a first connector housing and a second connector housing.

Exemplary embodiments of the present invention are hereinafter described. It is emphasized that any terms used herein relating to the orientation of the invention components or the direction of movement of the components including but not limited to "upper", "lower", "upward", "downward", "below" and the like have been selected for the purpose of simplifying the description of the invention, particularly in view of the drawing figures, for ease of understanding the invention and should not be construed as limiting the scope of the invention. It is believed that using non-descriptive terms unassociated with the orientation of the invention components or direction of movement such as "first", "second" or the like would render the reading and comprehension of the detailed description of the exemplary embodiments of the present invention difficult.

The exemplary embodiments of the present invention are generally introduced in FIGS. 1-4. A connector position assurance device 10 of the present invention is used as a component of a connector assembly 110 of the present invention. The connector assembly 110 as discussed in more detail below includes the connector position assurance device 10, a first connector housing 12 and a second connector housing 14.

Figure 5:
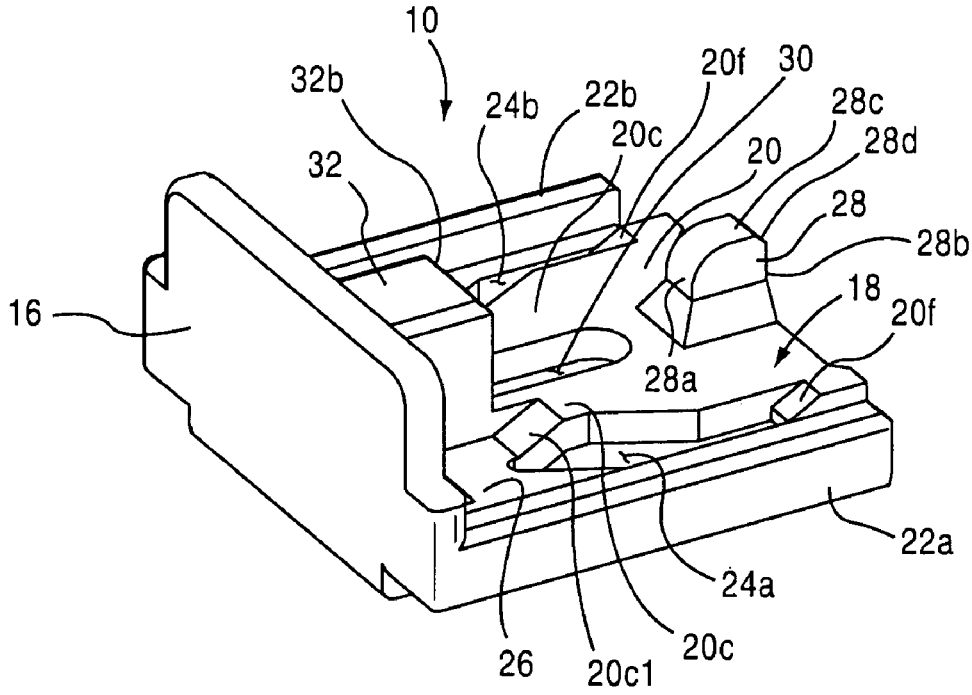
FIG. 5 is an enlarged perspective view of the connector position assurance device of the present invention.
Figure 6:
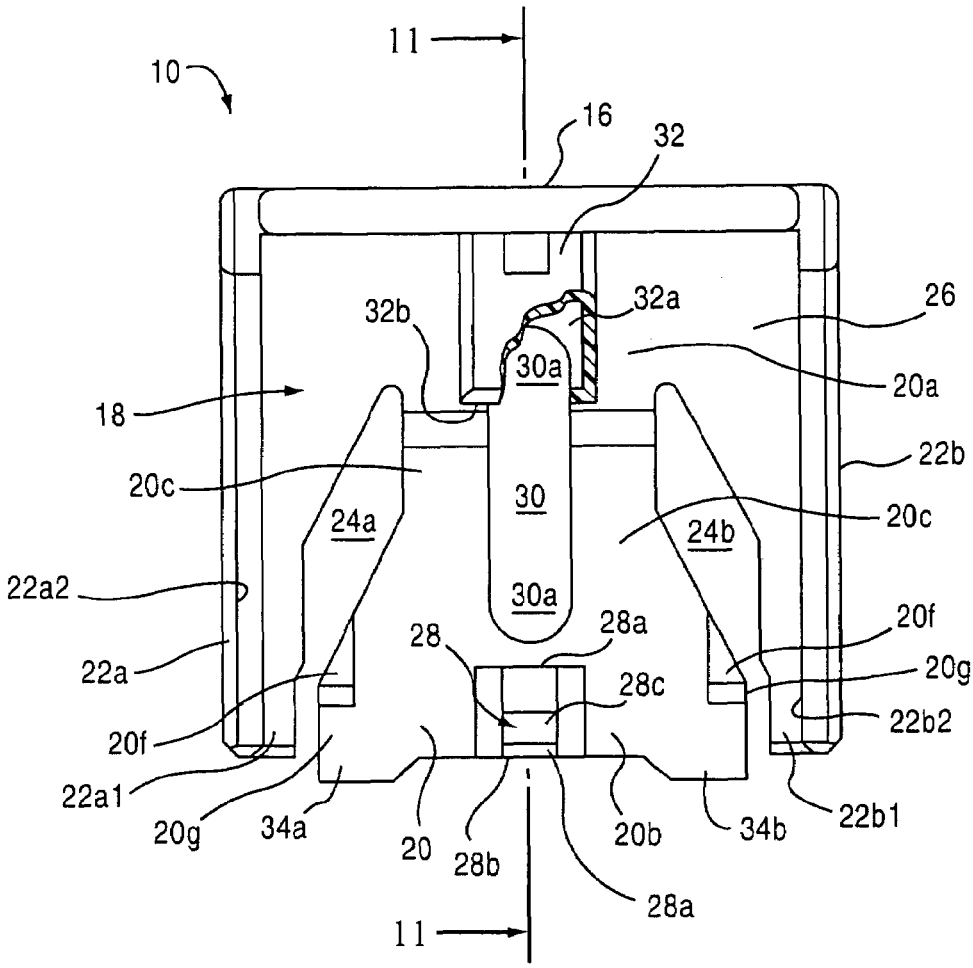
FIG. 6 is an enlarged top plan view of the connector position assurance device shown in FIG. 5.

With reference to FIGS. 5-8, the connector position assurance device 10 includes a base panel member 16 and a latch assembly 18. The latch assembly 18 is connected to and extends generally perpendicularly from the base panel member 16. Also, the latch assembly 18 has a tongue part 20 and a pair of rigid rails 22*a* and 22*b*. The pair of rails 22*a* and 22*b* is disposed apart from and extends parallel to one another. The tongue part 20 is positioned between and yet is disposed apart from the pair of rails 22*a* and 22*b* to define a pair of open-ended stop-receiving channels 24*a* and 24*b* that are positioned between the tongue part 20 and respective ones of the pair of rails 22*a* and 22*b* as best shown in FIGS. 5 and 6. One of ordinary skill in the art would appreciate that each one of the pair of rigid rails 22*a* and 22*b* is intended to be disposed in a fixed position and is not intended to be movable for purposes of the present invention although either one of the pair of rails might move somewhat if a sufficient force is applied thereto.

Figure 9:
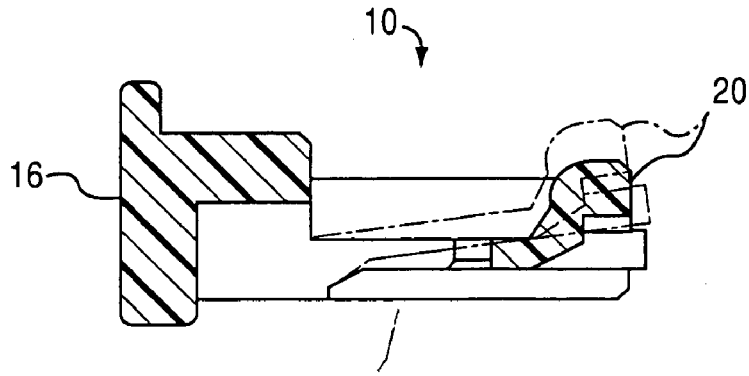
FIG. 9 is a side elevational view in cross-section illustrating a tongue part of the connector position assurance device in a relaxed normal position and an upward flexed position drawn in phantom.
Figure 10:
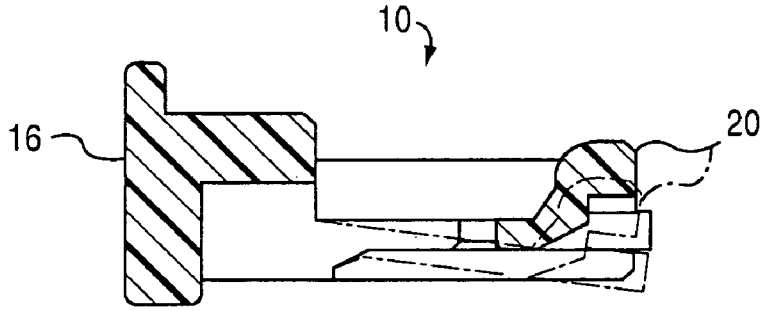
FIG. 10 is a side elevational view in cross-section illustrating the tongue part of the connector position assurance device in the relaxed normal position and a downward flexed position drawn in phantom.

In FIGS. 5 and 6, the latch assembly 18 includes an anchor panel part 26. The anchor panel part 26 is connected to and between the base panel member 16 and the tongue part 20. In FIG. 6, the tongue part 20 has a tongue fixed end 20*a* and an opposing tongue free end 20*b*. The tongue part 20 is connected to the anchor panel part 26 at the tongue fixed end 20*a* in a cantilever fashion such that the tongue part 20 is movable in an upward direction as shown by the broken lines in FIG. 9 and in a downward direction as shown by the broken lines in FIG. 10. In the upward direction in FIG. 9, the tongue part 20 moves to and between a relaxed normal position as shown by the solid lines and an upward flexed position as shown by the broken lines. In the downward direction in FIG. 10, the tongue part 20 moves to and between the relaxed normal position as shown by the solid lines and a downward flexed position as shown by the broken lines. By comparing FIGS. 9 and 10, a skilled artisan would comprehend that the downward flexed position is opposite the upward flexed position. Further, when the tongue part 20 is in either the upward flexed position or the downward flexed position, the tongue part 20 is resiliently biased to the relaxed normal position as reflected by the solid lines in both FIGS. 9 and 10.

Figure 7:
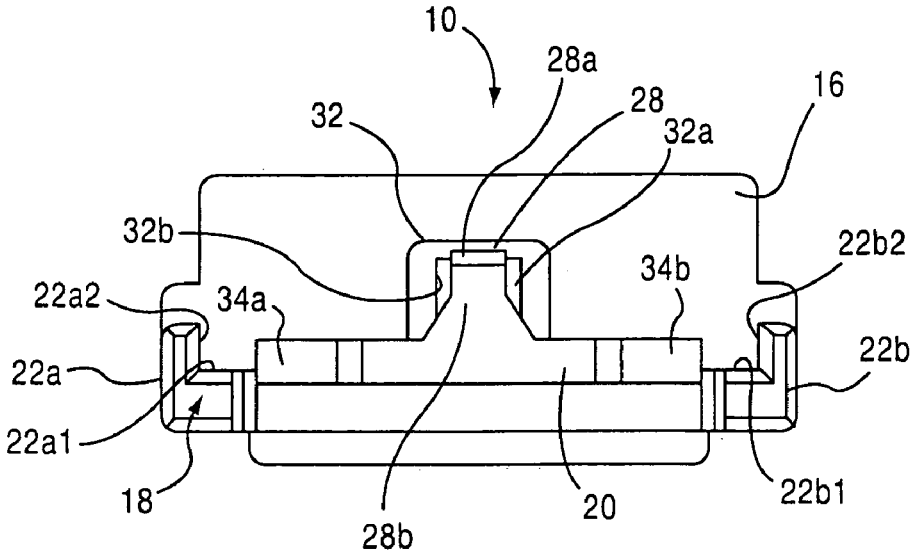
FIG. 7 is a front elevational view of the connector position assurance device shown in FIG. 5.

Additionally, the latch assembly 18 as shown in FIGS. 5-8 includes a follower projection 28 connected to the tongue part 20 adjacent the tongue free end 20*b* thereof. The follower projection 28 projects from the tongue part 20 in the upward direction. Also, although not by way of limitation, the follower projection 28 is positioned centrally between to the pair of rails 22*a* and 22*b* as best shown in FIGS. 6 and 7. In FIGS. 5 and 6, the tongue part 20 has a pair of tongue part legs 20*c* that defines a slot 30 therebetween that is formed though the tongue part 20. The slot 30 is disposed centrally of the tongue part 20 and extends from the tongue fixed end 20*a* and towards the follower projection 28.

Again with reference to FIGS. 5-8, connector position assurance device 10 further includes a hollow box element 32 having a box-shaped cavity 32*a* formed therein (FIGS. 6 and 7) and a box-shaped opening 32*b* (FIGS. 6 and 7) into the box-shaped cavity 32*a* facing the follower projection 28. The box element 32 is integrally connected to the anchor panel part 26 and the base panel member 16. Further, the box element 32 extends from the base panel member 16 and terminates to cover a rear end portion 30*a* (FIG. 6) of the slot 30 with the rear end portion 30*a* of the slot 30 being in communication with the box-shaped cavity 32*a*.

Figure 8:
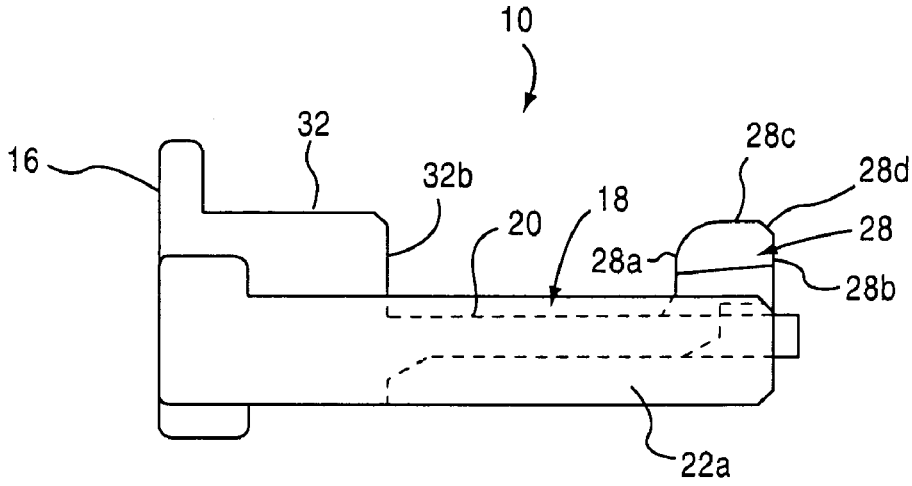
FIG. 8 is a side elevational view of the connector position assurance device shown in FIG. 5.

As best shown in FIGS. 5-8, the follower projection 28 has a rear surface 28*a*, a front surface 28*b*, a top surface 28*c* and an inclined surface 28*d*. As best shown in FIGS. 5, 6 and 8, the rear surface 28*a* faces the box-shaped opening 32*b*. The front surface 28*b* is opposed to the rear surface 28*a* and faces away from the box-shaped opening 32*b*. The inclined surface 28*d* is inclined relative to and interconnects the top surface 28*c* and the front surface 28*b*. The top surface 28*c* interconnects the inclined surface 28*d* and the rear surface 28*a*. Although not by way of limitation, the top surface 28*c* and the inclined surface 28*d* are interconnected in an arcuate manner as best shown in FIGS. 5 and 8.

Figure 11:
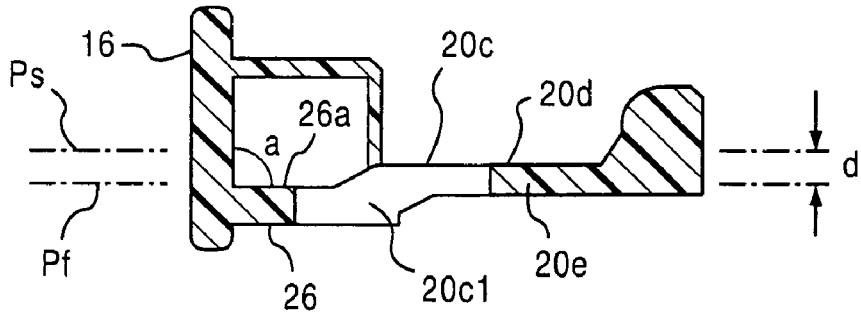
FIG. 11 is a side elevational view in cross-section taken along lines 11-11 in FIG. 5.

As best shown in FIG. 11, the anchor panel part 26 is integrally connected perpendicularly to the base panel member as represented by angle a. Note that a top surface 26*a* of the anchor panel part 26 is disposed in a first plane Pf represented by the alternating long and short dashed lines and a top surface 20*d* of at least a forward portion 20*e* of the tongue part is disposed in a second plane Ps that extends parallel to the first plane Pf in a space-apart manner at a distance d. By way of example only and not by way of limitation, the first plane Pf is disposed below the second plane Ps. This construction is achieved by a pair of angled leg portions 20*c*1 with each one of the pair of angled leg portions 20*c*1 being a component of a respective one of the pair of tongue part legs 20*c*.

Furthermore, as best shown in FIGS. 6 and 7, the latch assembly 18 includes a pair of block elements 34*a* and 34*b* that are integrally connected at the tongue free end 20*b* of the tongue part 20. Each one of the pair of block elements 34*a* and 34*b* is laterally disposed apart from one another on opposing sides of the follower projection 28 and project forwardly of the tongue free end 20*b*. In FIGS. 5 and 6, the tongue part 20 includes a pair of ramps 20*f*. Each ramp 20*f* is disposed at an outer lateral edge 20*g* of the tongue part 20 and inclines upwardly relative to the tongue fixed end 20*a* and towards the tongue free end 20*b*.

With reference to FIGS. 6 and 7, although not by way of limitation, each one of the pair of rails 22*a* and 22*b* is angled as viewed in cross-section. Specifically, rail 22*a* is configured in cross-section generally as an L-shape while rail 22*b* is configured in cross-section generally as a mirrored-image of the L-shape. Each rail 22*a* and 22*b* has a bottom rail surface 22*a*1 and 22*b*1 respectively and a side rail surface 22*a*2 and 22*b*2 respectively with the bottom rail surfaces and the side rail surfaces being perpendicular to one another.

Figure 13:
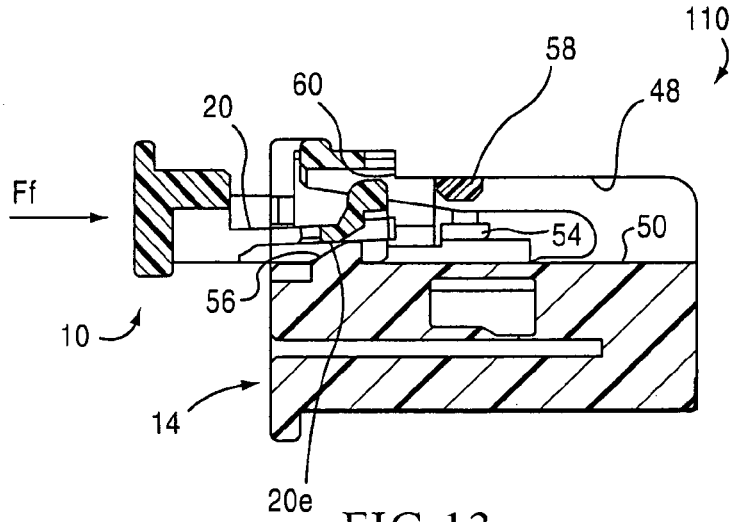
FIG. 13 is a side elevational view shown in cross-section of the connector position assurance device as it is being inserted into the second connector inner cavity of the second connector housing.
Figure 14A:
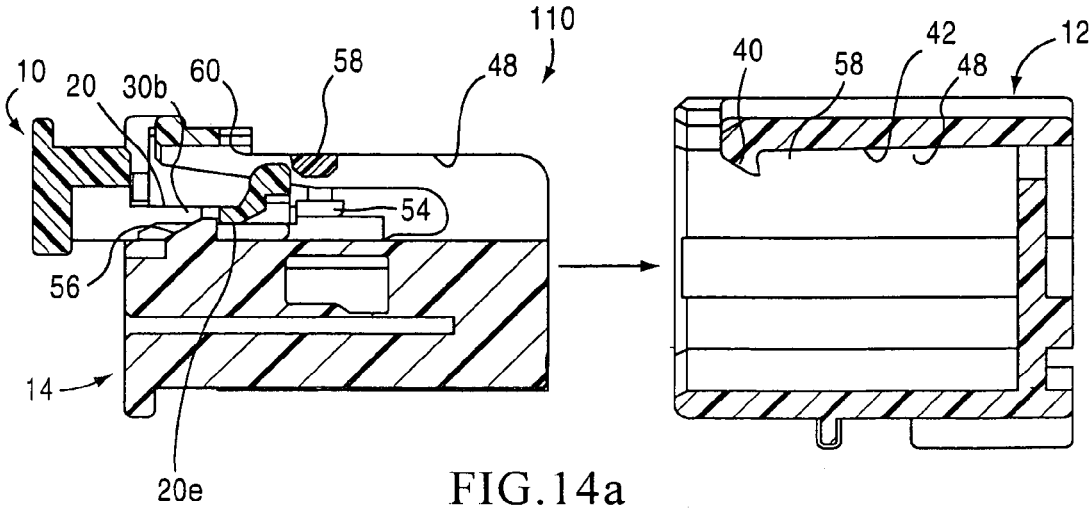
FIG. 14A is a side elevational view shown in cross-section of the connector position assurance device inserted into a second connector inner cavity of the second connector housing with the connector position assurance device in a pre-set stage.
Figure 14B:
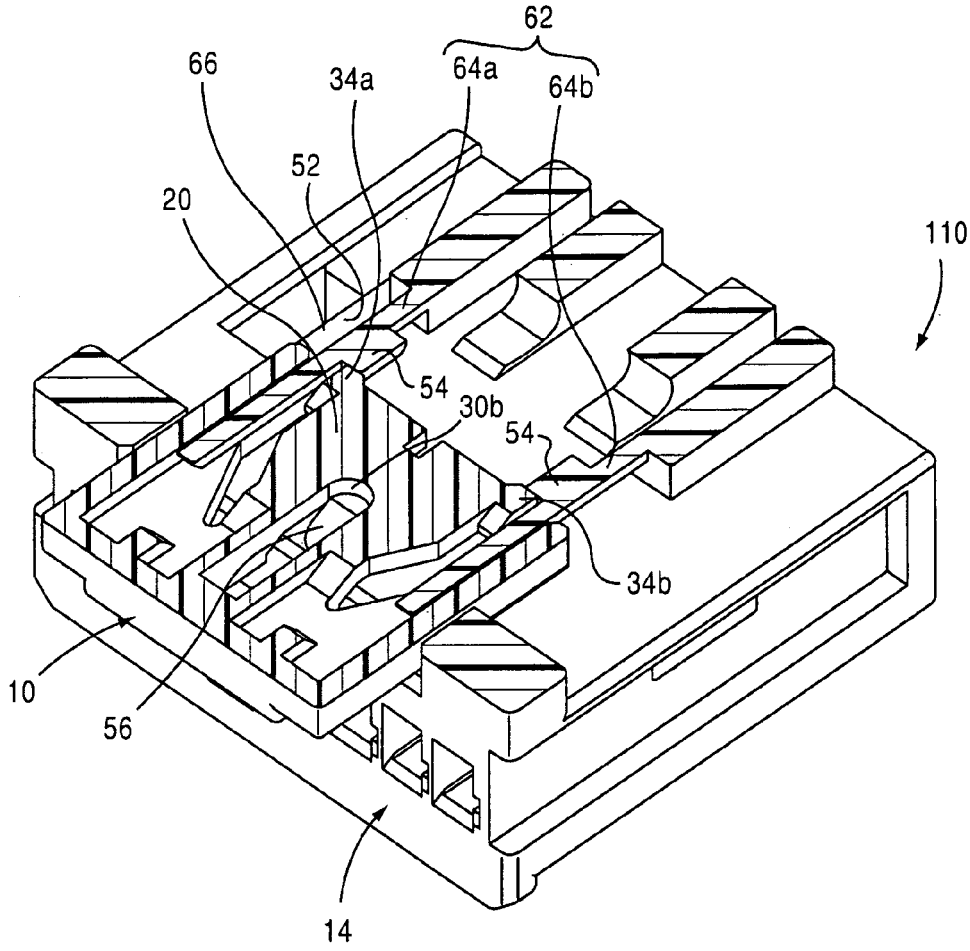
FIG. 14B is a perspective view partially in cross-section of the connector position assurance device inserted into the second connector inner cavity of the second connector housing in the pre-set stage.
Figure 15:
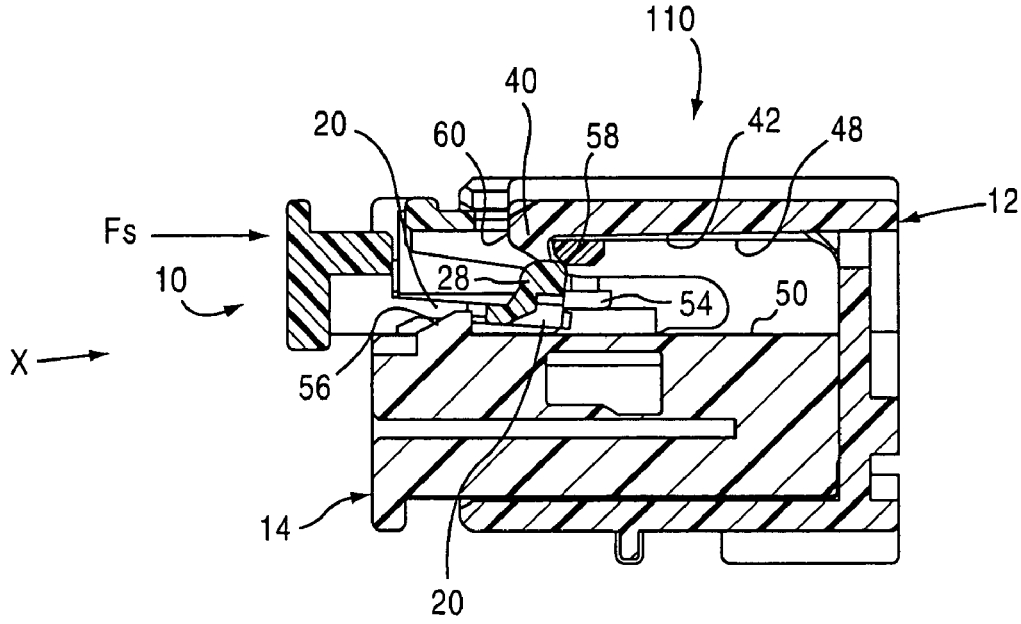
FIG. 15 is a side elevational view shown in cross-section of the second connector housing being inserted into the first connector housing with the connector position assurance device in the pre-set stage.
Figure 16A:
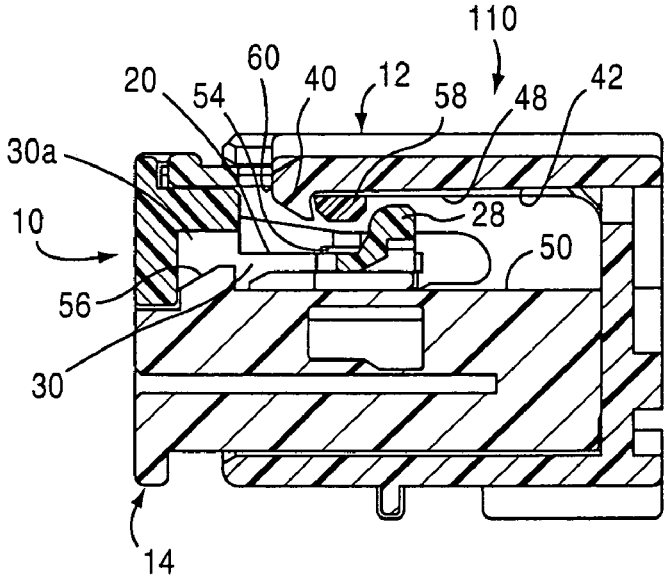
FIG. 16A is a side elevational view shown in cross-section of the connector position assurance device in its final locked stage.

Another exemplary embodiment of the connector assembly 110 of the present invention as mentioned above is generally introduced in FIGS. 1-4 and 11-15B. The connector assembly 110 includes the first connector housing 12, the second connector housing 14 and the connector position assurance device 10. The first connector housing 12 has a first connector opened end 36 and a first connector inner cavity 38 as best shown in FIG. 1 and a first connector locking protrusion 40 as shown in FIGS. 14A, 15 and 16A. The first connector locking protrusion 40 extends from a first connector upper wall 42 into the first connector inner cavity 38 (FIG. 1).

With reference to FIGS. 1-4 and 14A, 15 and 16A, the second connector housing 14 is sized and adapted to be received by the first connector inner cavity 38 through the first connector opened end 36. The second connector housing 14 has a second connector opened end 44, a second connector inner cavity 46, a second connector latch assembly 48 with a cross-bar locking element 58 and a second connector latch hole 60 defined in part by the cross-bar locking element 58, a second connector bottom wall 50 facing the second connector latch assembly 48, a pair of facially opposing second connector side walls 52, a pair of stop elements 54 disposed between the second connector latch assembly 48 and the second connector bottom wall 50, a second connector upwardly projecting locking protrusion 56 projecting upwardly from the second connector bottom wall 50. As best shown in FIG. 1, the second connector housing 14 includes a joist structure 62 disposed within the second connector inner cavity 46. The joist structure 62 has a pair of joists 64*a* and 64*b* disposed apart from one another and extends in the insertion direction X. A respective one of the pair of joists 64*a* and 64*b* is disposed apart from a respective one of the second connector side walls 52 and the second connector bottom wall 50 to form a rail-receiving channel 66 therebetween.

As best shown in FIG. 1. the second connector latch assembly 48 includes a pair of parallel bars 48*a* disposed apart from one another to define a channel 48*b* therebetween. Respective distal ends of the pair of parallel bars are integrally connected at a rear portion of the second connector housing 14 in a cantilevered manner. The cross-bar locking element 58 spans the pair of parallel bars forwardly of the second connector housing 14.

The second connector latch assembly 48 is operative to move to and between a normal, relaxed condition (as shown in FIGS. 12, 13, 14A and 16A) and a downward flexed condition (as shown only in FIG. 15) for reasons discussed below. The second connector latch assembly 48 is resiliently biased to the normal relaxed condition.

Figure 2:
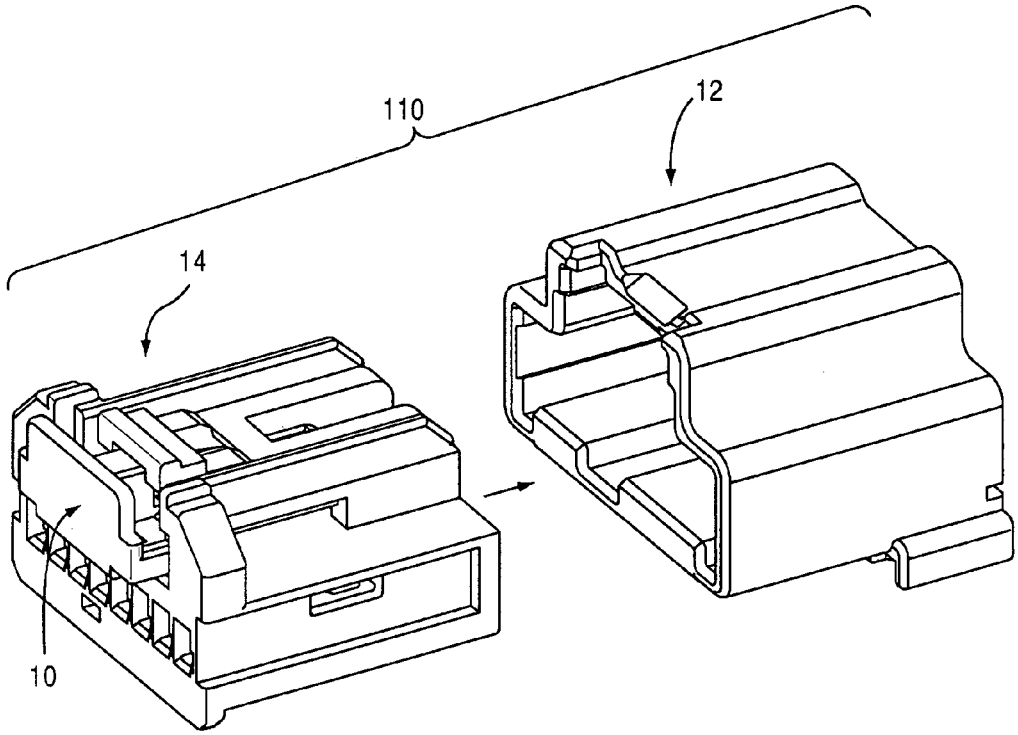
FIG. 2 is an exploded perspective view with the connector position assurance device being received by the first connector housing in a pre-set stage.
Figure 3:
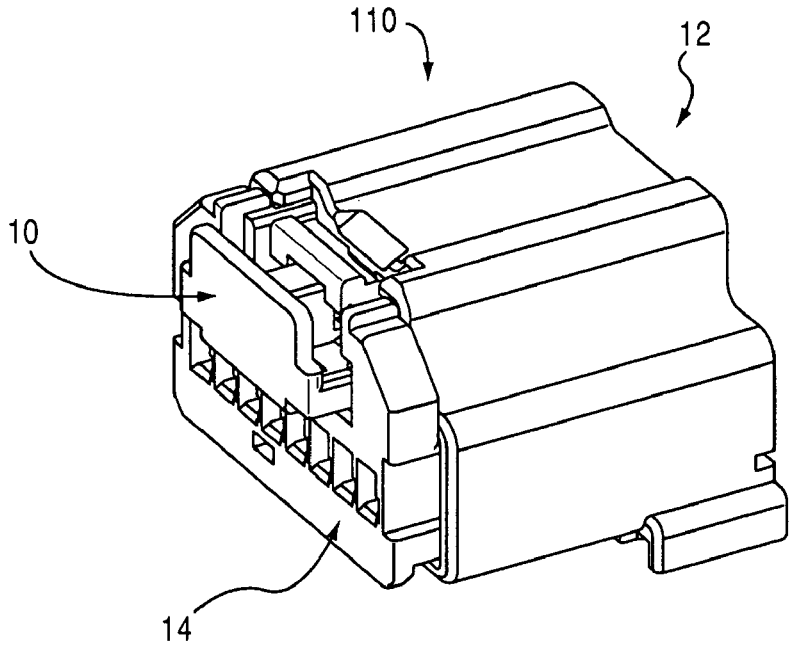
FIG. 3 is an exploded perspective view with the first connector housing being received by the second connector housing with the connector position assurance device being in a pre-set stage.
Figure 4:
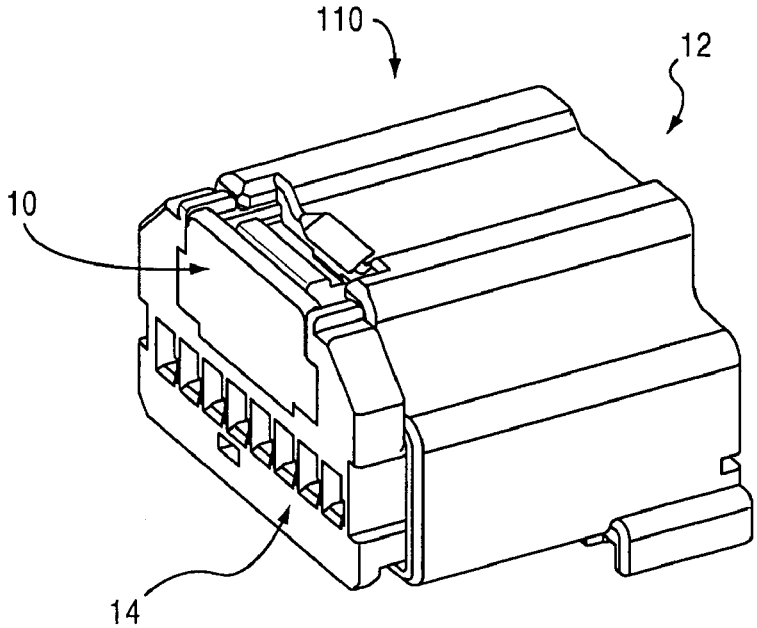
FIG. 4 is a perspective view with the first connector housing being received by the second connector housing with the connector position assurance device being in a final locked stage.
Figure 12:
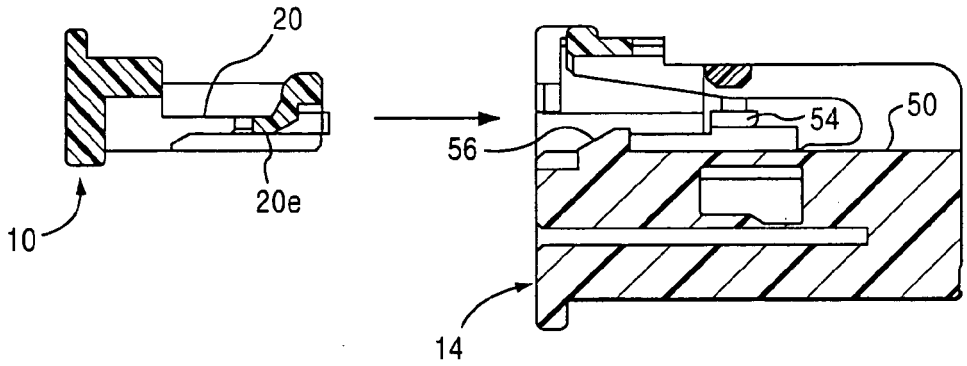
FIG. 12 is a side elevational view shown in cross-section of the connector position assurance device before being inserted into a second connector inner cavity of the second connector housing.

In FIGS. 1-4, the connector position assurance device 10 sized and adapted to be received by the second connector inner cavity 46. In FIGS. 1 and 12, respective ones of the pair of rails 22*a* and 22*b* of the connector position assurance device 10 is aligned with respective ones the rail-receiving channels 64*a* and 64*bb* of the second connector housing 14 in order to slidably receive the pair of rails 22*a* and 22*b* in a close-fitting relationship. As best shown in FIG. 13, the connector position assurance device 10 is inserted into the second connector inner cavity 46 in the insertion direction at a first insertion force Ff sufficient to cause the tongue part 20 to slide over the second connector upwardly projecting locking protrusion 56 thereby moving the tongue part 20 from the relaxed normal position shown in FIG. 12 to the upward flexed position shown in FIG. 13 while the tongue part 20 is in sliding contact with and slides over the second connector upwardly projecting locking protrusion 56 as best shown in FIG. 13. Then the tongue part 20 moves from the upward flexed position as shown in FIG. 13 to the relaxed normal position as shown in FIGS. 14A and 14B when a forward portion 20*e* of the tongue part 20 loses sliding contact with the second connector upwardly projecting locking protrusion 56 and the follower projection 28 confronts the cross-bar locking element 58 and the slot 30 receives the second connector upwardly projecting locking protrusion 56 at a forward end portion 30*b* (FIG. 6) of the slot 30 to render the connector position assurance device 10 in a pre-set stage partially within the second connector inner cavity 46. This configuration is also shown in FIGS. 2 and 3 as perspective views.

Figure 16B:
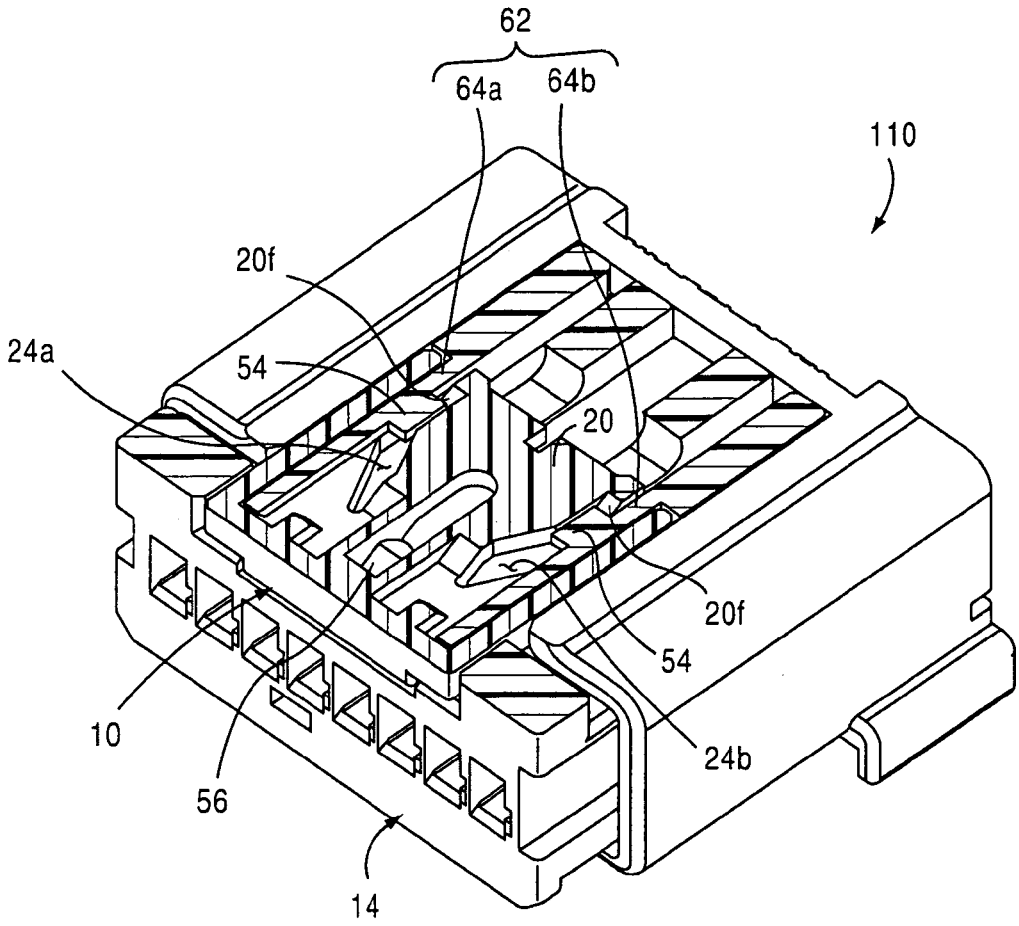
FIG. 16B is a perspective view partially in cross-section of the connector position assurance device inserted into the second connector inner cavity of the second connector housing in the final locked stage.

Thereafter the second connector housing 14 with the connector position assurance device 10 in the pre-set stage is inserted into the first connector inner cavity 38 as shown in FIGS. 2 and 3 and in sequence in FIGS. 14A through 16B in the insertion direction X at a second insertion force Fs by being received in the first connector inner cavity 38 such that the first connector locking protrusion 40 in sliding contact with the cross-bar locking element 58 pushes downwardly on the cross-bar locking element 58 (see FIG. 15) thereby moving the second connector latch assembly 48 from the normal relaxed condition (for example in FIG. 14A) to the downward flexed condition as shown in FIG. 15. The second connector latch assembly 48 returns to the normal relaxed condition as shown in FIGS. 16A and 16B as the first connector locking protrusion 40 loses sliding contact with the cross-bar locking element 58 (FIG. 16A) and the first connector locking protrusion 40 in sliding contact with the follower projection 28 pushes downwardly on the follower projection (FIG. 15) thereby moving the tongue part 20 from the relaxed normal position (for example, in FIG. 15) to the downward flexed position (FIG. 15) so that the forward portion 20*e* of the tongue part 20 in sliding contact with the pair of stop elements 54 slides underneath the pair of stop elements 54 and the follower projection 28 in sliding contact slides under the first connector locking protrusion 40 and the cross-bar locking element 58 (FIG. 15) and the tongue part 20 returns to the normal relaxed position (FIGS. 16A and 16B) after losing sliding contact with the cross-bar locking element 58 such that the pair of stop elements 54 is disposed within respective ones of the opened-ended stop-receiving channels 24*a* and 24*b* thereby rendering the connector position assurance device 10 in a final locked stage.

Although not by way of limitation, the second insertion force Fs is larger than the first insertion force Ff. Further, although not by way of limitation, this exemplary embodiment of the connector assembly 110 of the present invention describes a pair of stop elements 54 but one of ordinary skill in the art would appreciate that only one stop element can be used. Thus, there is at least one stop element employed for the present invention.

As best shown in FIG. 16B, a respective one of the pair of stop elements 54 is connected to a respective one of the pair of joists 64*a* and 64*b*. Each one of the pair of stop elements 64 extends from the respective one of the pair of joists 64*a* and 64*b* towards a center of the second connector inner cavity 46.

Additionally, as shown in FIG. 16B, the tongue part 20 has a pair of ramps 20*f*. Each ramp 20*f* is disposed at an outer lateral edge 20*g* of the tongue part 20 and inclines upwardly relative to the tongue fixed end 20*a* and towards the tongue free end 20*b*. Respective ones of the pair of ramps 20*f* are disposed at least adjacent to or abutting respective ones of the pair of stop elements 54 in a generally facially opposing manner. Respective ones of the pair of stop elements 54 are disposed in respective ones of the open-ended stop-receiving channels 24*a* and 24*b* when the connector position assurance device 10 is in the final locked stage.

With reference to FIG. 6, the latch assembly 18 includes an anchor panel part 26 and a pair of block elements 34*a* and 34*b*. The anchor panel part 26 is connected to and between the base panel member 16 and the tongue part 20. The tongue part 20 has the tongue fixed end 20*a* and the tongue free end 20*b* opposing the tongue fixed end 20*a*. The tongue part 20 is connected to the anchor panel part 26 at the tongue fixed end 20*a*. The pair of block elements 34*a* and 34*b* are integrally connected at the tongue free end 20*b* of the tongue part 20. Each one of the pair of block elements 34*a* and 34*b* is laterally disposed apart from one another on opposing sides of the follower projection 28 and projects forwardly of the tongue free end 20*b*. Respective ones of the pair of the block elements 34*a* and 34*b* are disposed at least adjacent to or abut respective ones of the pair of stop elements 54 in a generally facially opposing manner when the connector position assurance device 10 is in the pre-set stage.

It is appreciated that the connector position assurance device 10 of the present invention is not stressed when it is engaged either in its pre-set stage or in its final locked stage because the connector position assurance device is in its relaxed normal position. The connector position assurance device is only stressed when the tongue part moves from its relaxed normal position to either the upward flexed position or the downward flexed position. Furthermore, because the connector position assurance device includes a pair of rails that are received in a close-fitting relationship by the rail-receiving channels formed by the joist structure, the connector position assurance device is stably positioned within the second connector housing when connector position assurance device is engaged therewith.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A connector position assurance device, comprising:

a base panel member; and a latch assembly connected to and extending generally perpendicularly from the base panel member, the latch assembly having a tongue part and a pair of rigid rails disposed apart from and extending parallel to one another, the tongue part positioned between yet disposed apart from the pair of rails to define a pair of open-ended stop-receiving channels between the tongue part and respective ones of the pair of rails, each one of the pair of rails having a base rail piece connected to the base panel member and extending inwardly towards the tongue part and away from the base panel member and having a side rail piece integrally connected to the base panel member and the base rail piece and extending in an upward direction from the base rail piece and away from the base panel member such that one of the pair of rails forms a L-shape as viewed in cross-section and extends in its entirety from the base panel member as a L-shaped rail to terminate in a L-shaped free rail end and a remaining one of the pair of rails forms an inverse-L shape as viewed in cross-section and extends in its entirety from the base panel member as an inverse L-shaped rail to terminate in an inverse L-shaped free rail end.

2. A connector position assurance device according to claim 1, wherein the latch assembly includes an anchor panel part connected to and between the base panel member and the tongue part, the tongue part having a tongue fixed end and an opposing tongue free end, the tongue part connected to the anchor panel part at the tongue fixed end such that the tongue part is movable, in the upward direction, to and between a relaxed normal position and an upward flexed position and, in a downward direction, to and between the relaxed normal position and a downward flexed position being opposite the upward flexed position, the tongue part being resiliently biased to the relaxed normal position.

3. A connector position assurance device according to claim 2, wherein the latch assembly includes a follower projection connected to the tongue part adjacent the tongue free end thereof and projecting from the tongue part in the upward direction, the follower projection positioned centrally between the pair of rails.

4. A connector position assurance device according to claim 3, wherein the tongue part has a pair of tongue part legs defining a slot therebetween and formed though the tongue part, the slot being disposed centrally of the tongue part and extending from the tongue fixed end and towards the follower projection.

5. A connector position assurance device according to claim 2, wherein the anchor panel part is connected perpendicularly to the base panel member and is disposed in a first plane and at least a forward portion of the tongue part is disposed in a second plane extending parallel to the first plane in a space-apart manner.

6. A connector position assurance device according to claim 2, wherein the latch assembly includes a pair of block elements integrally connected at the tongue free end of the tongue part, each one of the pair of block elements being laterally disposed apart from one another on opposing sides of the follower projection and projecting forwardly of the tongue free end.

7. A connector position assurance device, comprising:

a base panel member;

a latch assembly connected to and extending generally perpendicularly from the base panel member, the latch assembly having a tongue part and a pair of rails disposed apart from and extending parallel to one another, the tongue part positioned between yet disposed apart from the pair of rails to define a pair of open-ended stop-receiving channels between the tongue part and respective ones of the pair of rails; and a hollow box element, wherein the latch assembly includes an anchor panel part connected to and between the base panel member and the tongue part, the tongue part having a tongue fixed end and an opposing tongue free end, the tongue part connected to the anchor panel part at the tongue fixed end such that the tongue part is movable, in an upward direction, to and between a relaxed normal position and an upward flexed position and, in a downward direction, to and between the relaxed normal position and a downward flexed position being opposite the upward flexed position, the tongue part being resiliently biased to the relaxed normal position, wherein the latch assembly includes a follower projection connected to the tongue part adjacent the tongue free end thereof and projecting from the tongue part in the upward direction, the follower projection positioned centrally between the pair of rails, wherein the tongue part has a pair of tongue part legs defining a slot therebetween and formed though the tongue part, the slot being disposed centrally of the tongue part and extending from the tongue fixed end and towards the follower projection, and wherein the hollow box element has a box-shaped cavity therein and a box-shaped opening into the box-shaped cavity facing the follower projection, the hollow box element is integrally connected to the anchor panel part and the base panel member, the hollow box element extends from the base panel member and terminates to cover a rear end portion of the slot with the rear end portion of the slot being in communication with the box-shaped cavity.

8. A connector position assurance device according to claim 7, wherein the follower projection has a rear surface, a front surface, a top surface and an inclined surface, the rear surface facing the box-shaped opening, the front surface being opposed to the rear surface and facing away from the box-shaped opening, the inclined surface being inclined relative to and interconnecting the top surface and front surface, the top surface interconnecting the inclined surface and the rear surface.

9. A connector position assurance device, comprising a base panel member; and a latch assembly connected to and extending generally perpendicularly from the base panel member, the latch assembly having a tongue part and a pair of rigid rails disposed apart from and extending parallel to one another, the tongue part positioned between yet disposed apart from the pair of rails to define a pair of open-ended stop-receiving channels between the tongue part and respective ones of the pair of rails, one of the pair of rails having an L-shape as viewed in elevation and a remaining one of the pair of rails having an inverse L-shape as viewed in elevation, wherein the latch assembly includes an anchor panel part connected to and between the base panel member and the tongue part, the tongue part having a tongue fixed end and an opposing tongue free end, the tongue part connected to the anchor panel part at the tongue fixed end such that the tongue part is movable, in an upward direction, to and between a relaxed normal position and an upward flexed position and, in a downward direction, to and between the relaxed normal position and a downward flexed position being opposite the upward flexed position, the tongue part being resiliently biased to the relaxed normal position, and wherein the tongue part includes a pair of ramps, each ramp being disposed at an outer lateral edge of the tongue part and inclining upwardly relative to the tongue fixed end and towards the tongue free end.

10. A connector assembly, comprising:

a first connector housing having a first connector opened end, a first connector inner cavity and a first connector locking protrusion extending from a first connector upper wall into the first connector inner cavity;

a second connector housing sized and adapted to be received by the first connector inner cavity through the first connector opened end, the second connector housing having a second connector opened end, a second connector inner cavity, a second connector latch assembly with a cross-bar locking element and a second connector latch hole defined in part by the cross-bar locking element, a second connector bottom wall facing the second connector latch assembly, a pair of facially opposing second connector side walls, at least one stop element disposed between the second connector latch assembly and the second connector bottom wall, a second connector upwardly projecting locking protrusion projecting upwardly from the second connector bottom wall, the second connector housing including a joist structure disposed within the second connector inner cavity, the joist structure having a pair of joists disposed apart from one another and extending in the insertion direction, a respective one of the pair of joists being disposed apart from a respective one of the second connector side walls and the second connector bottom wall to form a rail-receiving channel therebetween, the second connector latch assembly operative to move to and between a normal, relaxed condition and a downward flexed condition, the second connector latch assembly being resiliently biased to the normal relaxed condition; and a connector position assurance device sized and adapted to be received by the second connector inner cavity, the connector position assurance device having a base panel member and a latch assembly connected to and extending generally perpendicularly from the base panel member, the latch assembly having a tongue part with a tongue part forward portion and a pair of rails disposed apart from and extending parallel to one another, the tongue part positioned between yet disposed apart from the pair of rails to define a pair of open-ended stop-receiving channels between the tongue part and respective ones of the pair of rails, the tongue part formed with a slot and a follower projection connected to the tongue part forward of the base panel member and the slot, the tongue part movable, in an upward direction, to and between a relaxed normal position and an upward flexed position and, in a downward direction, to and between the relaxed normal position and a downward flexed position being opposite the upward flexed position, the tongue part being resiliently biased to the relaxed normal position, wherein, with respective ones of the pair of rails of the connector position assurance device aligned with respective ones the rail-receiving channels of the second connector housing in order to slidably receive the pair of rails in a close-fitting relationship, the connector position assurance device is inserted into the second connector inner cavity in the insertion direction at a first insertion force sufficient to cause the tongue part to slide over the second connector upwardly projecting locking protrusion thereby moving the tongue part from the relaxed normal position to the upward flexed position while the tongue part is in sliding contact with and slides over the second connector upwardly projecting locking protrusion and then the tongue part moves from the upward flexed position to the relaxed normal position when a forward end of the tongue part loses sliding contact with the second connector upwardly projecting locking protrusion, the follower projection confronts the cross-bar locking element and the slot receives the second connector locking protrusion at a forward end portion of the slot to render the connector position assurance device in a pre-set stage partially within the second connector inner cavity, thereafter the second connector housing with the connector position assurance device in the pre-set stage is inserted into the first connector inner cavity in the insertion direction by being received in the first connector inner cavity such that the first connector locking protrusion in sliding contact with the cross-bar locking element pushes downwardly on the cross-bar locking element thereby moving the second connector latch assembly from the normal relaxed condition to the downward flexed condition and the second connector latch assembly returns to the normal relaxed condition as the first connector locking protrusion loses sliding contact with the cross-bar locking element and the first connector locking protrusion in sliding contact with the follower projection pushes downwardly on the follower projection thereby moving the tongue part from the relaxed normal position to the downward flexed position so that the tongue part forward portion in sliding contact with the at least one stop element slides underneath the at least one stop element and the follower projection in sliding contact slides under the first connector locking protrusion and the cross-bar locking element and the tongue part returns to the normal relaxed position after losing sliding contact with the cross-bar locking element such that the at least one stop element is disposed within one of the opened-ended stop-receiving channels thereby rendering the connector position assurance device in a final locked stage.

11. A connector assembly according to claim 10, wherein the at least one stop element includes a pair of stop elements, a respective one of the pair of stop elements is connected to a respective one of the pair of joists, each one of the pair of stop elements extending from the respective one of the pair of joists towards a center of the second connector inner cavity.

12. A connector assembly according to claim 11, wherein the tongue part has a pair of ramps, each ramp being disposed at an outer lateral edge of the tongue part and inclining upwardly relative to the tongue fixed end and towards the tongue free end, respective ones of the pair of ramps being disposed at least adjacent to or abutting respective ones of the pair of stop elements in a generally facially opposing manner with respective ones of the pair of stop elements disposed in respective ones of the open-ended stop-receiving channels when the connector position assurance device is in the final locked stage.

13. A connector assembly according to claim 10, wherein the latch assembly includes an anchor panel part and a pair of block elements, the anchor panel part connected to and between the base panel member and the tongue part, the tongue part having a tongue fixed end and an opposing tongue free end, the tongue part connected to the anchor panel part at the tongue fixed end, the pair of block elements integrally connected at the tongue free end of the tongue part, each one of the pair of block elements being laterally disposed apart from one another on opposing sides of the follower projection and projecting forwardly of the tongue free end, respective ones of the pair of the block elements being disposed at least adjacent to or abutting respective ones of the pair of stop elements in a generally facially opposing manner when the connector position assurance device is in the pre-set stage.

* * * * *